US010218094B2

(12) United States Patent
Eriksen et al.

(10) Patent No.: US 10,218,094 B2
(45) Date of Patent: Feb. 26, 2019

(54) CONNECTORS HAVING A CABLE GRIPPING PORTION

(71) Applicant: PPC Broadband, Inc., East Syracuse, NY (US)

(72) Inventors: Kim Lundgren Eriksen, Tappernøje (DK); Harold J. Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 15/408,378

(22) Filed: Jan. 17, 2017

(65) Prior Publication Data

US 2017/0207555 A1 Jul. 20, 2017

Related U.S. Application Data

(60) Provisional application No. 62/279,609, filed on Jan. 15, 2016, provisional application No. 62/415,491, filed on Oct. 31, 2016.

(51) Int. Cl.

| | |
|---|---|
| ***H01R 9/05*** | (2006.01) |
| ***H01R 24/38*** | (2011.01) |
| *H01R 103/00* | (2006.01) |

(52) U.S. Cl.

CPC ..... *H01R 9/0524* (2013.01); *H01R 9/0512* (2013.01); *H01R 24/38* (2013.01); *H01R 2103/00* (2013.01)

(58) Field of Classification Search

CPC ..... H01R 2103/00; H01R 9/0521; H01R 13/62933; H01R 13/622

(Continued)

(56) References Cited

U.S. PATENT DOCUMENTS 5,466,173 A * 11/1995 Down ..... H01R 9/0518 439/578

5,470,257 A * 11/1995 Szegda ..... H01R 9/05 439/389

(Continued)

OTHER PUBLICATIONS

Mar. 30, 2017 International Search Report issued in International Application No. PCT/US2017/013826.

*Primary Examiner* — Thanh Tam Le

(74) *Attorney, Agent, or Firm* — Oliff PLC

(57) ABSTRACT

A cable connector includes an outer conductor engager, a body, a coupler, a compression sleeve, and a grounding member. The outer conductor engager is configured to receive an end of a coaxial cable. The body includes an annular ring portion coaxially aligned with the outer conductor engager along an axis, and the annular ring is configured to circumscribe the coaxial cable. The coupler is rotatably mounted relative to the outer conductor engager and the body, and the compression sleeve is disposed at an opposite axial side of the body relative to the coupler. The grounding member is configured to establish an electrical grounding path between the outer conductor engager and the coupler. The body includes a plurality of flexible fingers spaced about a periphery of the body. The flexible fingers include outer surfaces that extend radially outward from an outer surface of the connector body. As the compression sleeve is moved axially relative to the body in a direction toward the coupler, the compression sleeve urges the flexible fingers radially inward to engage an outer jacket of a coaxial cable.

69 Claims, 12 Drawing Sheets

(58) Field of Classification Search
USPC ..... 439/578, 583, 584, 310, 320
See application file for complete search history.

(56) References Cited

U.S. PATENT DOCUMENTS 6,089,912 A * 7/2000 Tallis ..... H01R 9/05 439/583
6,776,657 B1 * 8/2004 Hung ..... H01R 9/05 439/439
7,086,897 B2 * 8/2006 Montena ..... H01R 9/0524 439/460
7,118,416 B2 * 10/2006 Montena ..... H01R 13/5205 439/584
7,182,639 B2 * 2/2007 Burris ..... H01R 9/0518 439/578
7,252,546 B1 8/2007 Holland
7,261,594 B2 * 8/2007 Kodama ..... H01R 13/5808 439/578
7,288,002 B2 * 10/2007 Rodrigues ..... H01R 9/0521 439/439
7,371,113 B2 * 5/2008 Burris ..... H01R 9/0518 439/578
7,749,022 B2 * 7/2010 Amidon ..... H01R 13/6584 439/488
7,794,275 B2 * 9/2010 Rodrigues ..... H01R 9/05 439/584
7,811,112 B2 * 10/2010 Montena ..... H01R 13/5219 439/277
7,824,216 B2 * 11/2010 Purdy ..... H01R 24/40 439/578
7,892,024 B1 * 2/2011 Chen ..... H01R 13/65802 439/578
7,931,498 B2 * 4/2011 Skeels ..... H01R 9/0524 439/578
8,033,862 B2 * 10/2011 Radzik ..... H01R 24/40 439/578
8,062,063 B2 * 11/2011 Malloy ..... H01R 13/187 439/578
8,192,237 B2 * 6/2012 Purdy ..... H01R 9/0524 439/584
8,287,310 B2 * 10/2012 Burris ..... H01R 24/40 439/578
8,444,445 B2 * 5/2013 Amidon ..... H01R 9/0524 439/583
8,753,147 B2 * 6/2014 Montena ..... H01R 9/05 439/502
8,834,200 B2 * 9/2014 Shaw ..... H01R 13/46 439/578
8,840,429 B2 * 9/2014 Thomas ..... H01R 9/0521 439/584
8,915,751 B2 * 12/2014 Wood ..... H01R 9/0524 439/578
8,915,753 B2 * 12/2014 Holland ..... H01R 9/05 439/578
8,944,846 B2 * 2/2015 Lee ..... H01R 9/0524 439/584
9,004,931 B2 * 4/2015 Montena ..... H01R 9/0524 439/253
2007/0093128 A1 4/2007 Thomas et al.
2007/0155232 A1 * 7/2007 Burris ..... H01R 9/0518 439/578
2012/0135639 A1 5/2012 Paglia et al.
2013/0059468 A1 * 3/2013 Wood ..... H01R 9/05 439/584
2013/0178096 A1 7/2013 Matzen
2014/0120766 A1 5/2014 Meister et al.
2016/0285212 A1 9/2016 Davidson, Jr. et al.

* cited by examiner

CONNECTORS HAVING A CABLE GRIPPING PORTION

CROSS-REFERENCE TO RELATED APPLICATIONS

This nonprovisional application claims the benefit of U.S. Provisional Application No. 62/279,609, filed on Jan. 15, 2016, and U.S. Provisional Application No. 62/415,491, filed on Oct. 31, 2016, the disclosures of which are incorporated herein by reference in their entirety.

BACKGROUND

A coaxial cable is prepared for connection to another cable, or to another RF device, by a coaxial cable connector. Preparation typically requires the use of several specialized tools including a stripping tool and a compression tool. The stripping tool removes a portion of the compliant outer jacket to expose a signal-carrying inner conductor and an outer grounding, or braided, conductor of the cable. The compression tool, on the other hand, inserts a grounding/retention post into the prepared end of the cable to effect an electrical and mechanical connection between the cable and an outer body or housing of the cable connector.

The step of compressing/inserting the grounding/retention post into the prepared end of the coaxial cable also requires a holding fixture to align the prepared end of the cable while a driver compresses a barbed annular sleeve of the grounding/retention post into/beneath the outer jacket of the cable. As such, the outer jacket may be compressed between the barbed annular sleeve and a fixed-diameter outer housing of the cable connector. Compression of the outer jacket causes the barbed annular sleeve to engage the braided conductor of the cable, thereby retaining the grounding/retention post of the connector to the coaxial cable.

Some cable types such as polyethylene (PE) and plenum can be difficult to install when using conventional "post" style connectors due to the length of the post and barbs on the post. Thus, it may be desirable to provide a connector that provides an alternative method for seizing the cable to the connector.

SUMMARY

According to various aspects of the disclosure, a cable connector includes an outer conductor engager, a body, a coupler, a compression sleeve, a radially compressible grounding member, and an end cap. The outer conductor engager is configured to receive an end of a coaxial cable. The body includes an annular ring portion coaxially aligned with the outer conductor engager along an axis, and the annular ring is configured to circumscribe the coaxial cable. The coupler is rotatably mounted relative to the outer conductor engager and the body, and the compression sleeve is disposed at an opposite axial side of the body relative to the coupler. The grounding member is configured to establish an electrical grounding path between the outer conductor engager and the coupler. The body includes a plurality of flexible fingers spaced about a periphery of the body. The flexible fingers include outer surfaces that extend radially outward from an outer surface of the connector body. As the compression sleeve is moved axially relative to the body in a direction toward the coupler, the compression sleeve urges the flexible fingers radially inward to engage an outer jacket of a coaxial cable.

In some aspects, the axial movement of the compression sleeve relative to the body compresses the outer jacket of the coaxial cable and an outer conductor of the coaxial cable against the outer conductor engager.

In some aspects, the grounding member is configured to be sandwiched between a forward facing surface of the body and rearward facing surfaces of the coupler and the outer conductor engager.

In some aspects, the cable connector includes a sealing member disposed between the body and the coupler to provide a watertight seal therebetween.

According to various aspects of the disclosure, a cable connector includes an outer conductor engager, a body, a coupler, a compression sleeve, and a clamp member. The outer conductor engager is configured to receive an end of a coaxial cable, and the coupler rotatably mounted relative to the outer conductor engager and the body. The body includes an annular ring portion coaxially aligned with the outer conductor engager along an axis, and the annular ring is configured to circumscribe the coaxial cable. The compression sleeve is disposed at an opposite axial side of the body relative to the coupler, and the clamp member is configured to circumscribe the end of the coaxial cable. As the compression sleeve is moved axially relative to the outer conductor engager, the compression sleeve is configured to urge the clamp member radially inward to clamp the end of the coaxial cable between an inner surface of the clamp member and the outer conductor engager.

In some aspects, the clamp member includes a band portion and at least one raised portion extending radially outward from the band portion, and the body includes at least one opening corresponding to the at least one raised portion.

According to various aspects, the band portion is disposed at an interior of the body, and the at least one raised portion extends radially outward through the at least one opening in the body.

According to some aspects, the at least one raised portion extends radially outward beyond an outer circumferential surface of the body.

In various aspects, as the compression sleeve is moved axially relative to the outer conductor engager, the compression sleeve urges the at least one raised portion of the clamp member radially inward, which in turn urges the band portion of the clamp member radially inward.

In accordance with some aspects, the cable connector may include a grounding member configured to establish an electrical grounding path between the outer conductor engager and the coupler.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
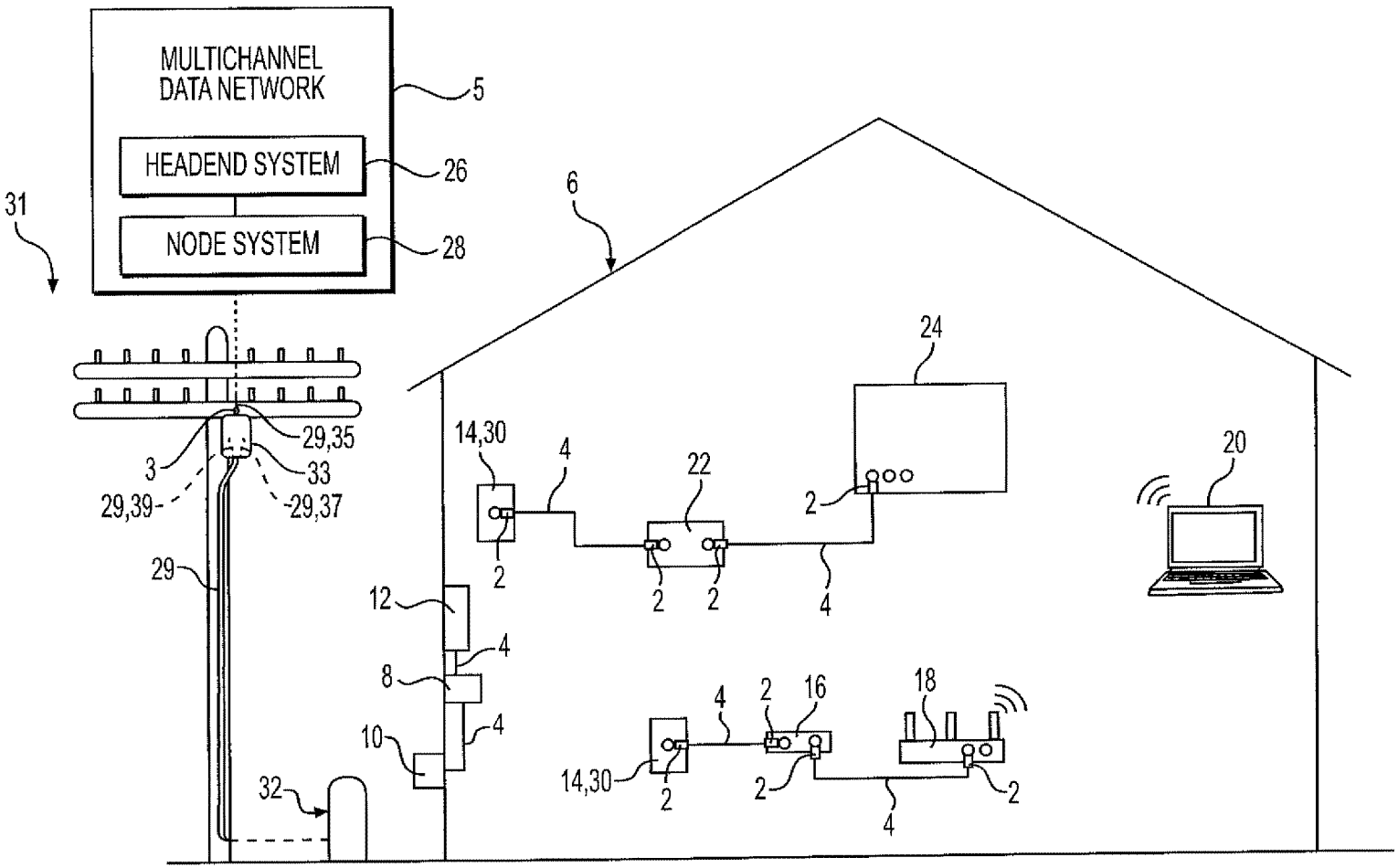
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

In some embodiments, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range of 1125 MHz to 1675 MHz. MoCA compatible devices can form a private network inside the environment 6.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
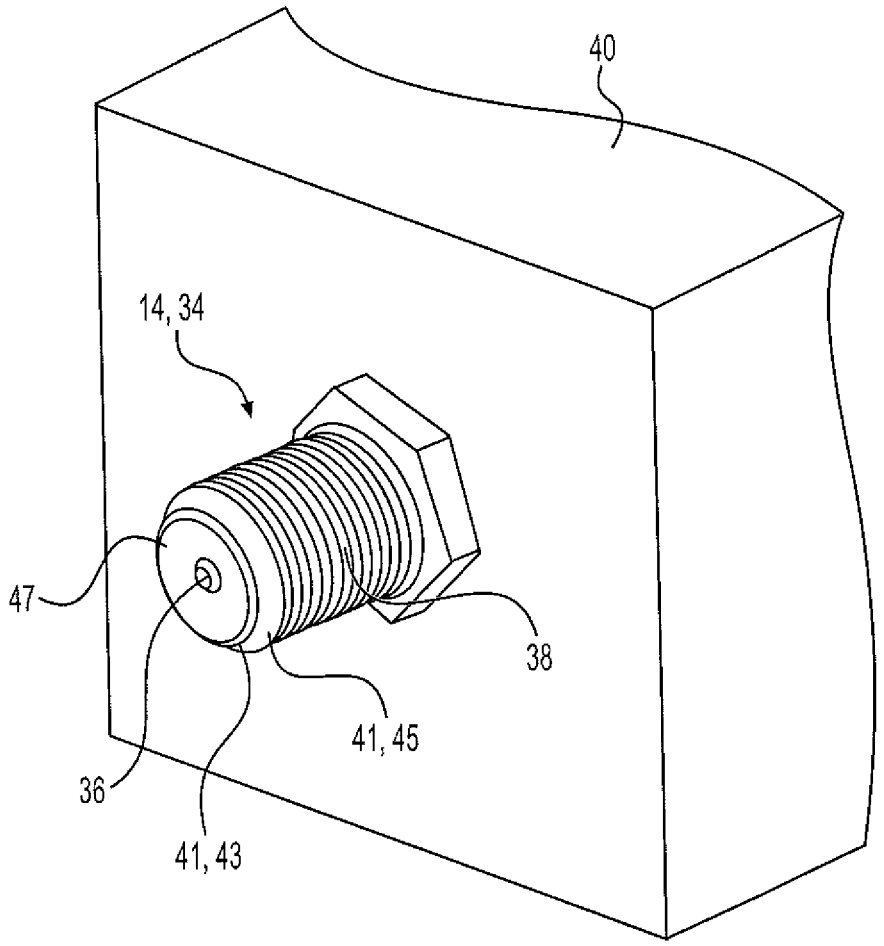
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
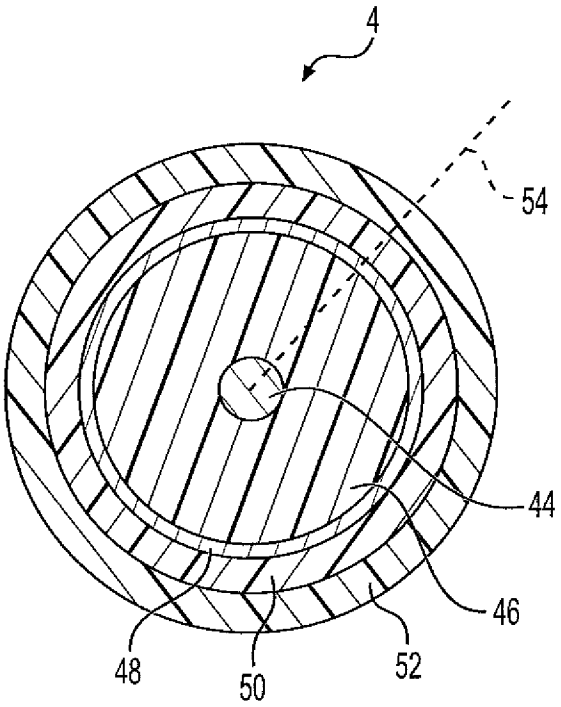
FIG. 4 is a cross-sectional view of the exemplary coaxial cable of FIG. 3.
Figure 3:
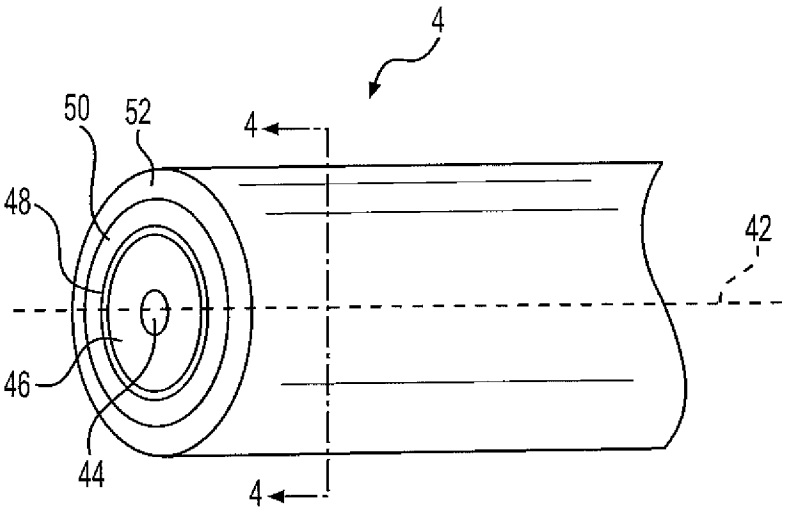
FIG. 3 is a perspective view of an exemplary coaxial cable in accordance with various aspects of the disclosure.
Figure 5:
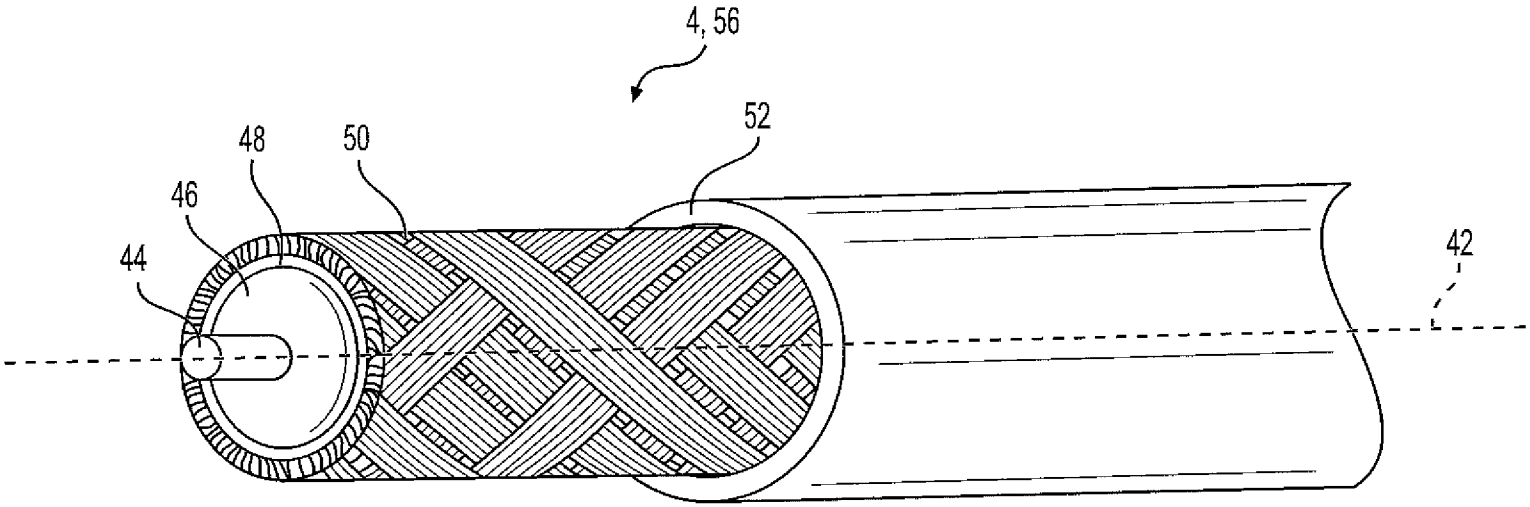
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50, and the jacket 52 can vary based upon parameters corresponding to broadband communication standards or installation equipment.

Figure 6:
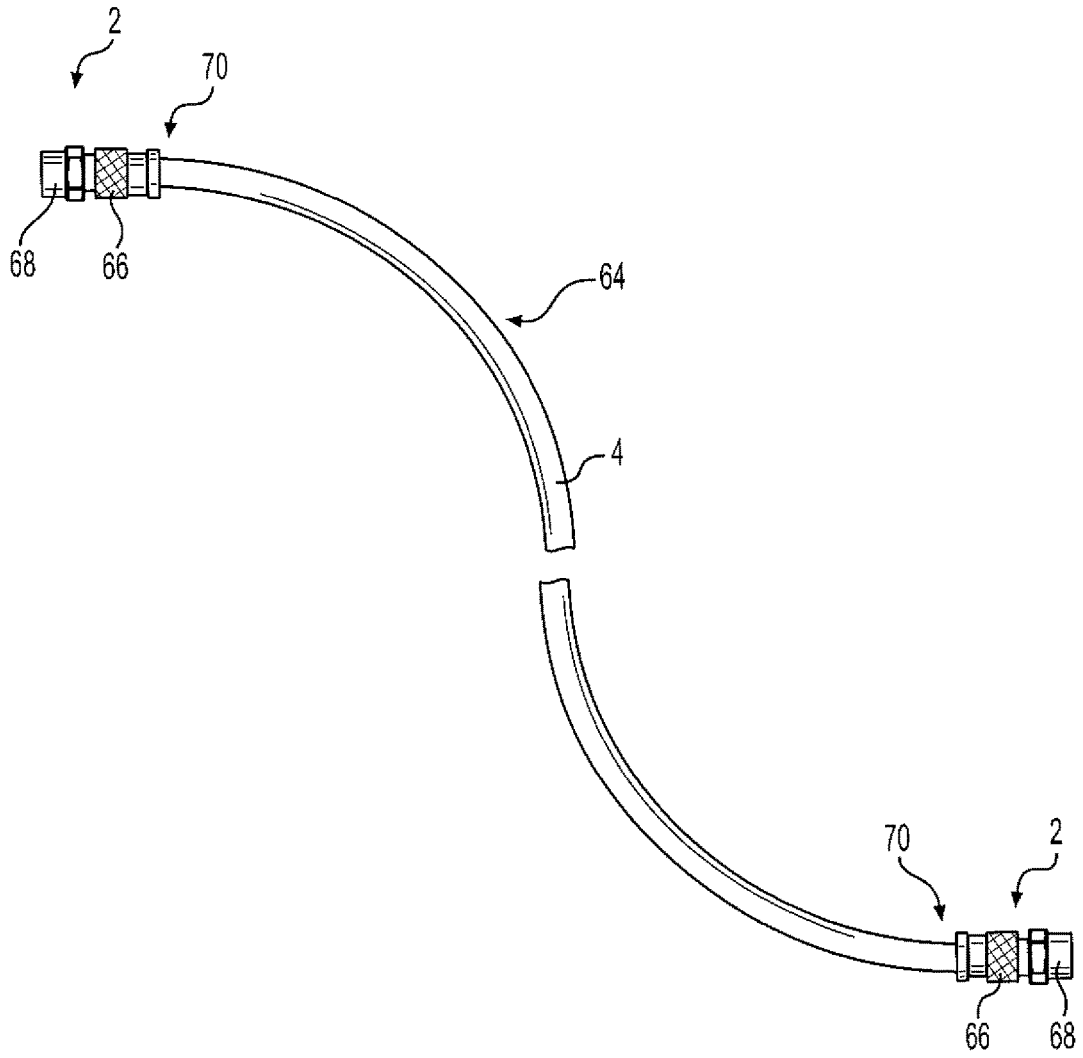
FIG. 6 is a top view of one embodiment of a coaxial cable jumper or cable assembly which is configured to be operatively coupled to the multichannel data network.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

Figure 7:
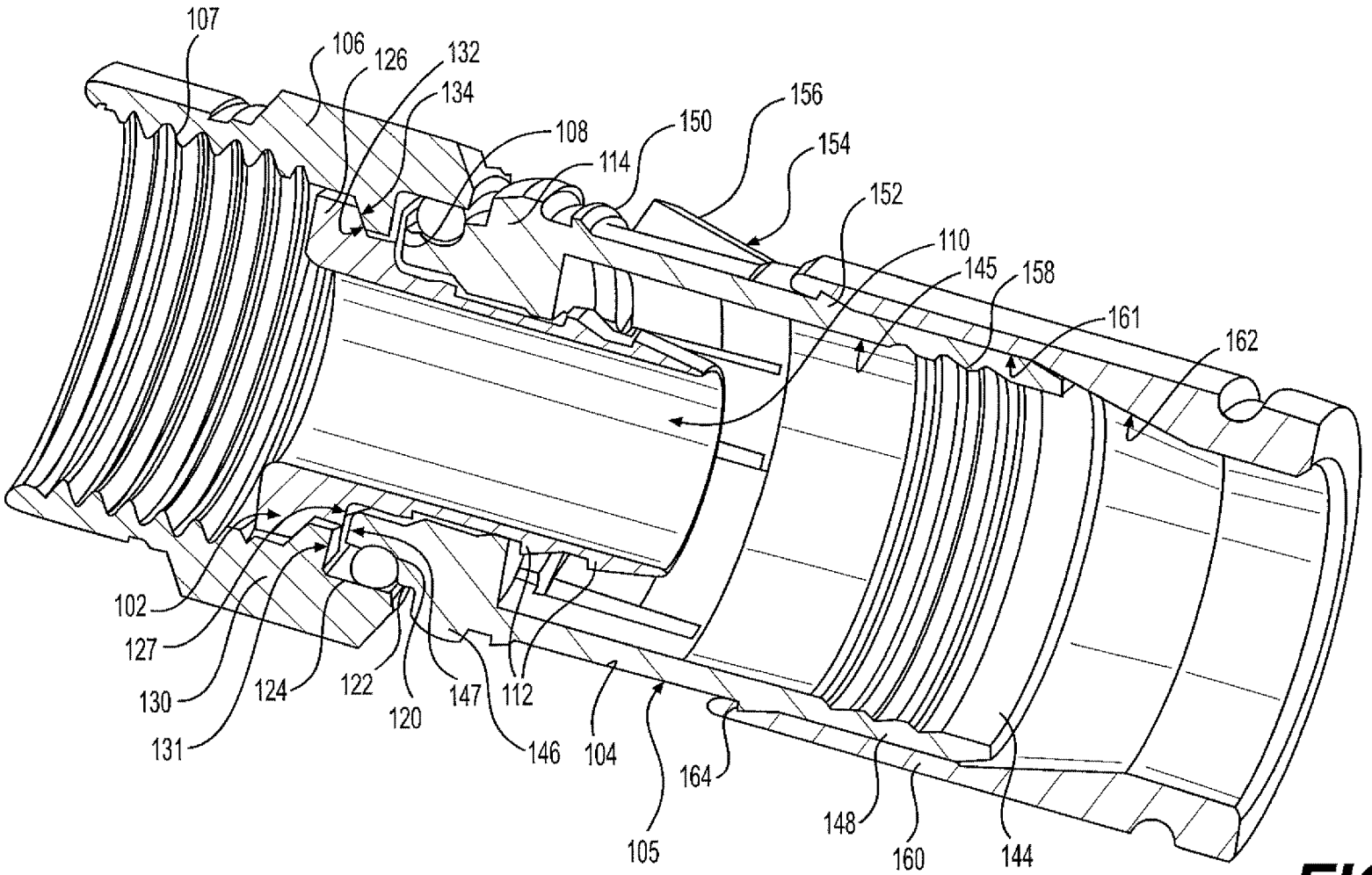
FIG. 7 is a cross-sectional view of an exemplary connector disposed in accordance with various aspects of the disclosure.
Figure 8:
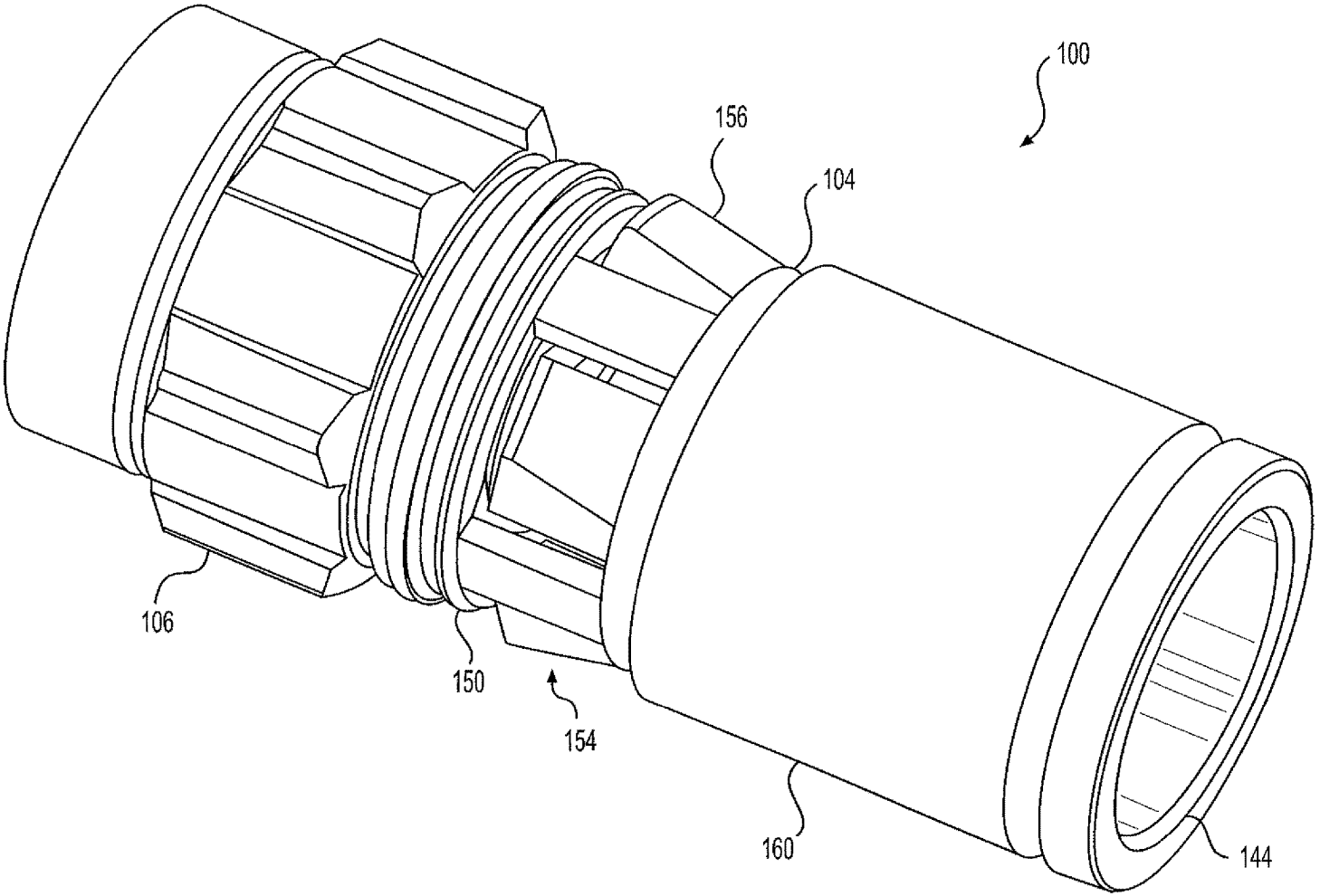
FIG. 8 is an isometric view of the connector of FIG. 7.
Figure 9:
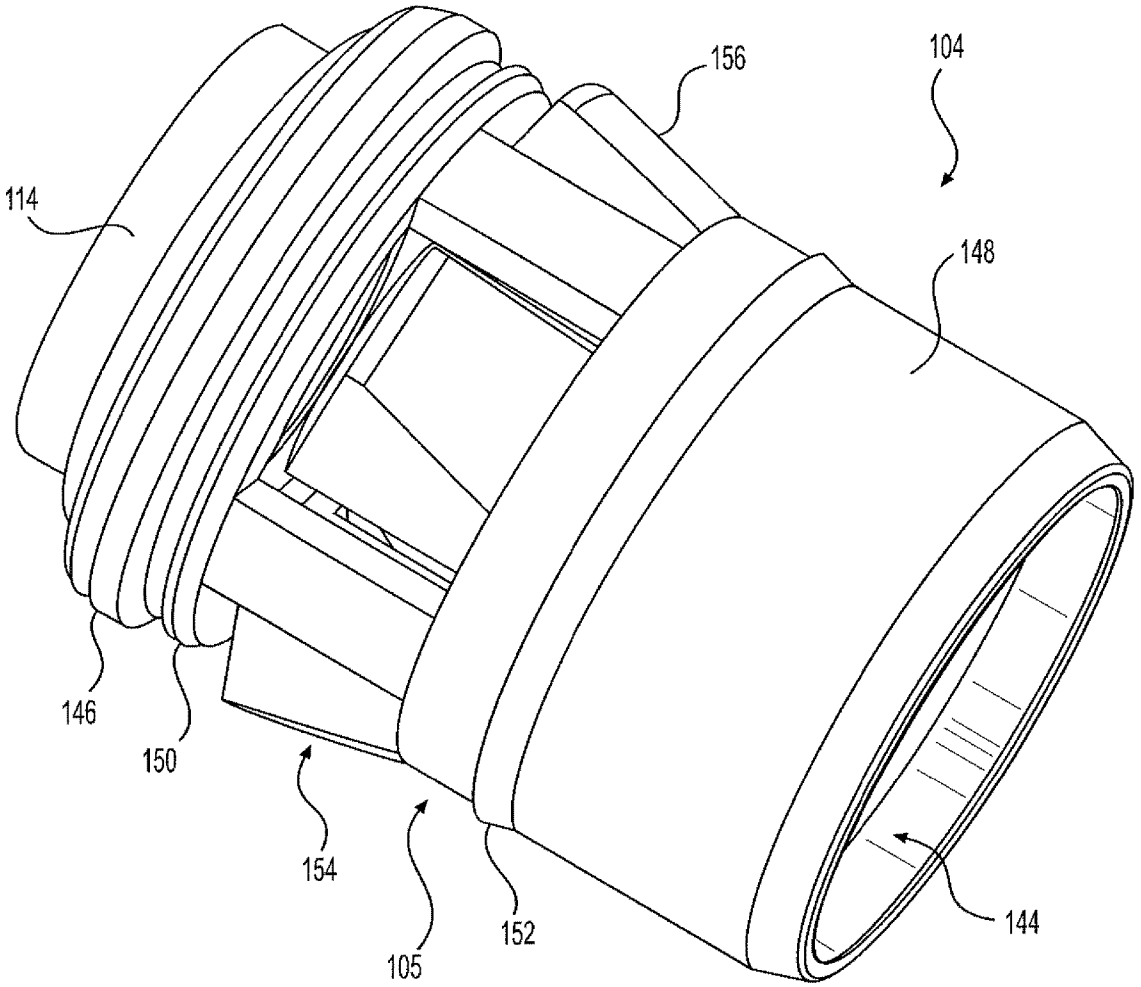
FIG. 9 is an isometric view of the connector body of the connector of FIG. 7.

According to the disclosure, the aforementioned connectors 2 may be configured as coaxial cable connector 100, as illustrated in FIGS. 7-9. For the purposes of establishing a directional frame of reference, the forward and rearward directions relative to the connector 100 are given by arrows F and R, respectively. When the connector 100 is installed on an interface port 14, a forward end, portion, or direction is proximal to, or toward, the interface port 14, and a rearward end, portion, or direction is distal, or away, from the interface port 14.

For purposes of this disclosure, with reference to the connector 100, a pre-installed or uninstalled state or configuration refers to the connector 100 before it is coupled with the coaxial cable 4 and the interface port 14. A partially-installed/assembled state refers to the connector 100 when it is coupled with the coaxial cable 4, but not with the interface port 14. An installed or fully-installed state refers to the connector 100 when it is coupled with the coaxial cable 4 and the interface port 14.

Referring now to FIG. 7, the coaxial cable connector 100 includes an outer conductor engager or post 102, a connector body or housing 104, a threaded coupler 106, and a conducting grounding member 108. The outer conductor engager 102 includes a forward flange 114 and an aperture 110 for accepting a portion of the coaxial cable 4. The forward flange 114 includes an annular groove 120 extending about its outer peripheral surface 122. A sealing member 124 may be received in the annular groove 120 to provide a watertight seal between the outer conductor engager 102 and the coupler 106.

In the described embodiment, the outer conductor engager 102 is configured to be inserted between the outer conductor 50 and the insulator 46 of the coaxial cable 4. Outward-facing barbs 112 of the outer conductor engager 102 are structured and arranged to establish contact with the outer conductor 50 to provide mechanical and electrical continuity between the outer conductor 50 and the outer conductor engager 102, and, thereby, the coaxial cable connector 100. In this way, electrical continuity, and accordingly a ground path and RFI shield, may be established and maintained from the outer conductor 50 of coaxial cable through the outer conductor engager 102, the connector body 104, the grounding member 108, and the coupler 106 to the interface port 14.

The connector body 104 defines an aperture 144 for receiving a portion of the coaxial cable 4. The connector body 104 includes a forward annular ring portion 146 and a rearward annular ring portion 148. The rearward annular ring portion 148 includes one or more annular ridges 158 on an inner surface 145 of the connector body. The annular ridges 158 may be continuous or intermittent about the periphery of the inner surface 145. A forward circumferential ridge 150 may be disposed on an outer circumferential surface 105 of the connector body 104 rearward of the forward annular ring portion 146. A rearward circumferential ridge 152 may be disposed on the outer circumferential surface 105 of the connector body 104 forward of the rearward annular ring portion 148. The forward and rearward circumferential ridges 150, 152 may be continuous or intermittent about the periphery of the outer surface 105.

Between the forward and rearward circumferential ridges 150, 152, a plurality of flexible fingers 154 may be delimited from the connector body 104. The flexible fingers 154 are spaced about a periphery of the connector body 104 and are radially compressible relative to a remainder of the connector body 104. The flexible fingers 154 include inner surfaces that define an aperture having a cross section that is substantially the same or slightly smaller than the cross section of the reminder of the connector body aperture 144. The flexible fingers 154 include outer surfaces 156 that extend radially outward from the outer surface 105 of the connector body. Also, the outer conductor engager 102 has an axial length that is selected such that the outward-facing barbs 112 of the outer conductor engager 102 are axially aligned with the flexible fingers 154 and the rearward end of the outer conductor engager 102 and a rearward free end of the outer conductor engager 102 is disposed at a middle portion of the connector body forward of the rearward ring portion 148 of the connector body. As such, radially-inward compression of the flexible fingers 154 by the compression ring 160 will urge the outer jacket 52 and the outer conductor 50 of the coaxial cable 4 against the outward-facing barbs 112.

It should be appreciated that, in some aspects, the flexible fingers 154 may be integral with the connector body 104 or separate from the connector body 104. For example, in some aspects, the flexible fingers 154 may be a continuous monolithic structure of the connector body 104, wherein a flexible web (not shown) provides the continuous structure of the flexible fingers 154 and the connector body 104. In such an embodiment, the flexible web occupies the spaces that appear between the flexible fingers 154 and the connector body 104 that are illustrated in FIGS. 7-9. As a result of the flexible web, the connector body 104 and the flexible fingers 154 provide a waterproof structure. Furthermore, the flexible web is configured to move and flex with radial compression of the fingers 154, thereby maintaining the waterproof structure of the connector body 104 and the flexible fingers 154 when the connector is assembled with a coaxial cable. In some aspects, the flexible web may be constructed of, for example, a plastic that permits stretching and flexing without tearing, cracking, or the like, which would destroy the waterproof nature of the connector body 104 and the flexible fingers 154.

The rearward annular ring portion 148 of the connector body is configured to engage a compression ring 160. The compression ring 160 includes a tapered inner wall 162 configured to ride over the rear annular ring portion 148 of the connector body 104. A forward portion of the compression ring 160 includes an annular notch 164 extending about its inner surface 161. The annular notch 164 may be continuous or intermittent about the periphery of the inner surface 161. The annular notch 164 cooperates with the rearward circumferential ridge 152 to maintain the compression ring 160 coupled with the connector body 104 prior to assembly with the coaxial cable 4 and cooperates with the forward circumferential ridge 150 to maintain the connector 100 and coaxial cable 4 in an assembled state.

The threaded coupler 106 includes a threaded portion 107 at its forward end for threadably engaging the threaded outer surface 38 of the interface port 14. A rearward end of the threaded coupler 106 is bearing-mounted to the forward flange 114 of the outer conductor engager 102 such that the coupler 106 is rotatable relative to the outer conductor engager 102 and the connector body 104. For example, a forward-facing surface 132 of an inwardly-extending flange 130 of the coupler 106 bears against a rearward-facing surface 134 of the outwardly extending flange 126 of the forward flange 114 of the outer conductor engager 102.

The grounding member 108 is configured to be sandwiched between a forward facing surface 147 of the forward annular ring portion 146 of the connector body 104 and the rearward facing surfaces 131, 127, respectively, of the inwardly-extending flange 130 of the coupler 106 and the outwardly extending flange 126 of the forward flange 114. The grounding member may have any configuration, such as for example, a ring-shape or a ring-shape with an axial flange, as shown in FIG. 7.

Having described the components of the connector 100 in detail, the use of connector 100 in terminating a coaxial cable 4 is now described. Cable 4 is prepared in conventional fashion for termination, as described above.

As shown in FIG. 7, when the connector is in the pre-installed and partially-installed states, and the pre-assembled and assembled states, the grounding member 108 is received between the forward facing surface 147 of the forward annular ring portion 146 of the connector body 104 and the rearward facing surfaces 131, 127, respectively, of the inwardly-extending flange 130 of the coupler 106 and the outwardly extending flange 126 of the forward flange 114.

In the partially-installed state, the coaxial cable 4 is inserted into the connector 100 (not shown). For example, the inner conductor 44, the insulator 46, the outer conductor 50, and the outer jacket 52 are inserted through the aperture 144 of the body 104. Particularly, the coaxial cable 4 is inserted into the connector 100 until a forward stop surface along the outer jacket 52 of the coaxial cable 4 abuts a rearward-facing stop surface 168 of the connector body 104. The inner conductor 44 and the insulator 46 extend through the aperture 110, and the inner conductor 44 extends beyond the forward flange 114 of the outer conductor engager 102.

The cable 4 may be inserted into connector 100 with the compression sleeve 160 coupled to the rear portion 148 of the connector body 104. Once the cable 4 is properly inserted, the compression sleeve 160 may be moved forward from a first position, as shown in FIG. 7, to a second position, where the compression sleeve 160 is moved axially forward so that the tapered inner wall 162 of the compression sleeve rides over the rear annular ring portion 148 of the connector body 104. A suitable tool may be used to effect movement of compression sleeve 160 from its first position to its second position securing the cable 4 to the connector body 104 by means of the annular notch 164 engaging the forward circumferential ridge 150, which also prevents the compression ring 160 from becoming inadvertently moved relative to the connector body 104.

As the compression sleeve 160 is urged to move forwardly, the connector body 104 is compressed on the outer jacket 52 of the coaxial cable 4 as the tapered inner wall 162 rides over the rear annular ring portion 148 of the connector body 104 and urges the rear annular ring portion 148, including the annular ridges 158, radially inward against the outer jacket 52. As the forward end of the compression sleeve 160 moves axially over the fingers 154, the fingers 154 are urged radially inward to compress the outer jacket 52 and the outer conductor 50 between the connector body 104 and the barbs 112 of the outer conductor engager 102.

During installation of the connector 100 to an interface port 14, the coupler 106 threadably engages the interface port 14. As the coupler 106 is fastened to the interface port 14, for example, by rotating the coupler 106 relative to the interface port 14, the interface port 14 is drawn toward the forward flange 114 of the outer conductor engager 102. Eventually, the grounding member 108 is compressed between the forward facing surface 147 of the forward annular ring portion 146 of the connector body 104 and the rearward facing surfaces 131, 127, respectively, of the inwardly-extending flange 130 of the coupler 106 and the outwardly extending flange 126 of the forward flange 114, and the free end of the interface port 14 will engage the forward flange 114 of the outer conductor engage 102.

According to other aspects of the disclosure, the aforementioned connectors 2 may be configured as coaxial cable connector 1100, as illustrated in FIGS. 10-13. For the purposes of establishing a directional frame of reference, the forward and rearward directions relative to the connector 1100 are given by arrows F and R, respectively. When the connector 1100 is installed on an interface port 14, a forward end, portion, or direction is proximal to, or toward, the interface port 14, and a rearward end, portion, or direction is distal, or away, from the interface port 14.

For purposes of this disclosure, with reference to the connector 1100, a pre-installed or uninstalled state or configuration refers to the connector 1100 before it is coupled with the coaxial cable 4 and the interface port 14. A partially-installed/assembled state refers to the connector 1100 when it is coupled with the coaxial cable 4, but not with the interface port 14. An installed or fully-installed state refers to the connector 1100 when it is coupled with the coaxial cable 4 and the interface port 14.

Referring now to FIGS. 10-13, the coaxial cable connector 1100 includes an outer conductor engager or post 1102, a connector body or housing 1104, a threaded coupler 1106, and a conducting grounding member (not shown). The outer conductor engager 1102 includes a forward flange 1114 and an aperture 1110 for accepting a portion of the coaxial cable 4. The forward flange 1114 includes an annular groove 1120 extending about its outer peripheral surface 1122. A sealing member 1124 may be received in the annular groove 1120 to provide a watertight seal between the outer conductor engager 1102 and the coupler 1106.

In the described embodiment, the outer conductor engager 1102 is configured to be inserted between the outer conductor 50 and the insulator 46 of the coaxial cable 4. Outward-facing barbs 1112 of the outer conductor engager 1102 are structured and arranged to establish contact with the outer conductor 50 to provide mechanical and electrical continuity between the outer conductor 50 and the outer conductor engager 1102, and, thereby, the coaxial cable connector 1100. In this way, electrical continuity, and accordingly a ground path and RFI shield, may be established and maintained from the outer conductor 50 of coaxial cable through the outer conductor engager 1102, the connector body 1104, the grounding member (not shown), and the coupler 1106 to the interface port 14.

The connector body 1104 defines an aperture 1144 for receiving a portion of the coaxial cable 4. The connector body 1104 includes a forward annular ring portion 1146 and a rearward annular ring portion 1148. The rearward annular ring portion 1148 includes one or more annular ridges 1158 on an inner surface 1145 of the connector body. The annular ridges 1158 may be continuous or intermittent about the periphery of the inner surface 1145. A forward circumferential ridge 1150 may be disposed on an outer circumferential surface 1105 of the connector body 1104 rearward of the forward annular ring portion 1146. A rearward circumferential ridge 1152 may be disposed on the outer circumferential surface 1105 of the connector body 1104 forward of the rearward annular ring portion 1148. The forward and rearward circumferential ridges 1150, 1152 may be continuous or intermittent about the periphery of the outer surface 1105.

Between the forward and rearward circumferential ridges 1150, 1152, a one or more openings or cutouts 1170 may be delimited in the connector body 1104. In an embodiment comprising a plurality of openings 1170, the openings 1170 are spaced about a periphery of the connector body 1104. For example, as shown in FIGS. 10-13, two openings 1170 may be diametrically opposed about the periphery of the connector body 1104. A clamp member 1172 includes a C-shaped band portion 1174 and one or more raised portions 1176 that extend radially outward from the band portion 1174. The band portion 1174 is disposed internally of the connector body 1104. The clamp member 1172 is disposed at a position relative to the connector body 1104 in the axial direction such that the one or more raised portions 1176 extend through the openings 1170 in the connector body 1104. The C-shaped band portion 1174 includes an inner surface that defines an aperture having a cross section that is slightly smaller than the cross section of the reminder of the connector body aperture 1144. The C-shaped band portion 1174 also provides the clamp member 1172 with radial flexibility/compressibility.

Also, the outer conductor engager 1102 has an axial length that is selected such that the outward-facing barbs 1112 of the outer conductor engager 1102 are axially aligned with the raised portions 1176 and the rearward end of the outer conductor engager 1102 and a rearward free end of the outer conductor engager 1102 is disposed at a middle portion of the connector body forward of the rearward ring portion 1148 of the connector body. As such, radially-inward compression of the raised portions 1176 by the compression ring 1160 will urge the clamp member 1172, the outer jacket 52, and the outer conductor 50 of the coaxial cable 4 against the outward-facing barbs 1112. The clamp member 1172 may also be tapered so as to allow for expansion when the coaxial cable 4 is inserted into the connector body 1104. Such expansion then pushes the raised portions 1176 of the clamp member 1172 radially outward so that the compression ring can 1160 can apply radial pressure after compression.

The rearward annular ring portion 1148 of the connector body is configured to engage a compression ring 1160. The compression ring 1160 includes a tapered inner wall 1162 configured to ride over the rear annular ring portion 1148 of the connector body 1104. A forward portion of the compression ring 1160 includes an annular notch 1164 extending about its inner surface 1161. The annular notch 1164 may be continuous or intermittent about the periphery of the inner surface 1161. The annular notch 1164 cooperates with the rearward circumferential ridge 1152 to maintain the compression ring 1160 coupled with the connector body 1104 prior to assembly with the coaxial cable 4 and cooperates with the forward circumferential ridge 1150 to maintain the connector 1100 and coaxial cable 4 in an assembled state.

The threaded coupler 1106 includes a threaded portion 1107 at its forward end for threadably engaging the threaded outer surface 38 of the interface port 14. A rearward end of the threaded coupler 1106 is bearing-mounted to the forward flange 1114 of the outer conductor engager 1102 such that the coupler 1106 is rotatable relative to the outer conductor engager 1102 and the connector body 1104. For example, a forward-facing surface 1132 of an inwardly-extending flange 1130 of the coupler 116 bears against a rearward-facing surface 1134 of the outwardly extending flange 1126 of the forward flange 1114 of the outer conductor engager 1112.

When the connector 1100 is in the pre-installed and partially-installed states, and the pre-assembled and assembled states, the grounding member (not shown) is received between the forward facing surface 1147 of the forward annular ring portion 1146 of the connector body 1104 and the rearward facing surfaces 1131, 1127, respectively, of the inwardly-extending flange 1130 of the coupler 1106 and the outwardly extending flange 1126 of the forward flange 1114. The grounding member (not shown) may be configured to be sandwiched between a forward facing surface 1147 of the forward annular ring portion 1146 of the connector body 1104 and the rearward facing surfaces 1131, 1127, respectively, of the inwardly-extending flange 1130 of the coupler 1106 and the outwardly extending flange 1126 of the forward flange 1114. The grounding member may have any configuration, such as for example, a ring-shape or a ring-shape with an axial flange.

Having described the components of the connector 1100 in detail, the use of connector 1100 in terminating a coaxial cable 4 is now described. Cable 4 is prepared in conventional fashion for termination, as described above.

Figure 10:
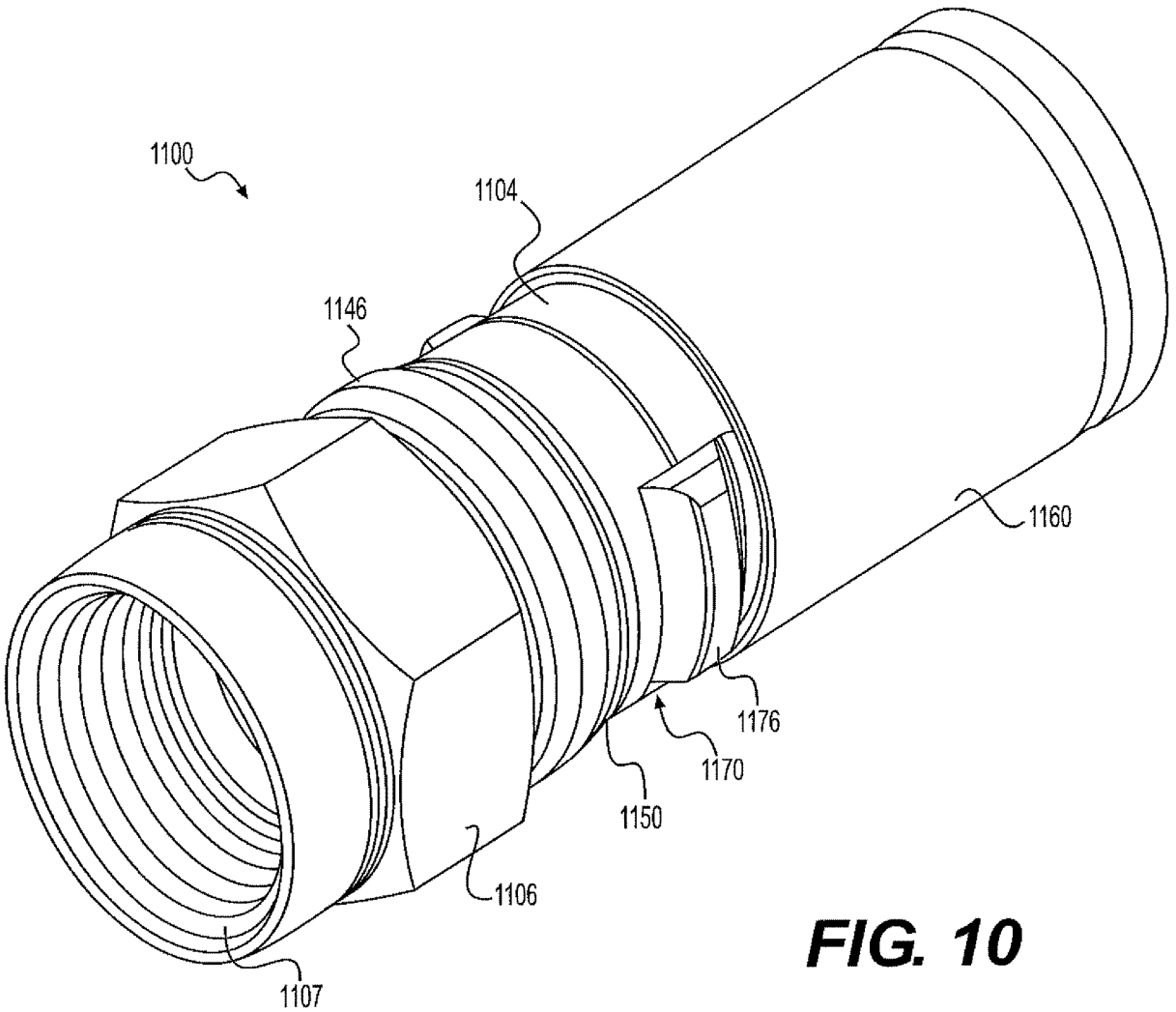
FIG. 10 is a perspective view of an exemplary connector in accordance with various aspects of the disclosure.
Figure 11:
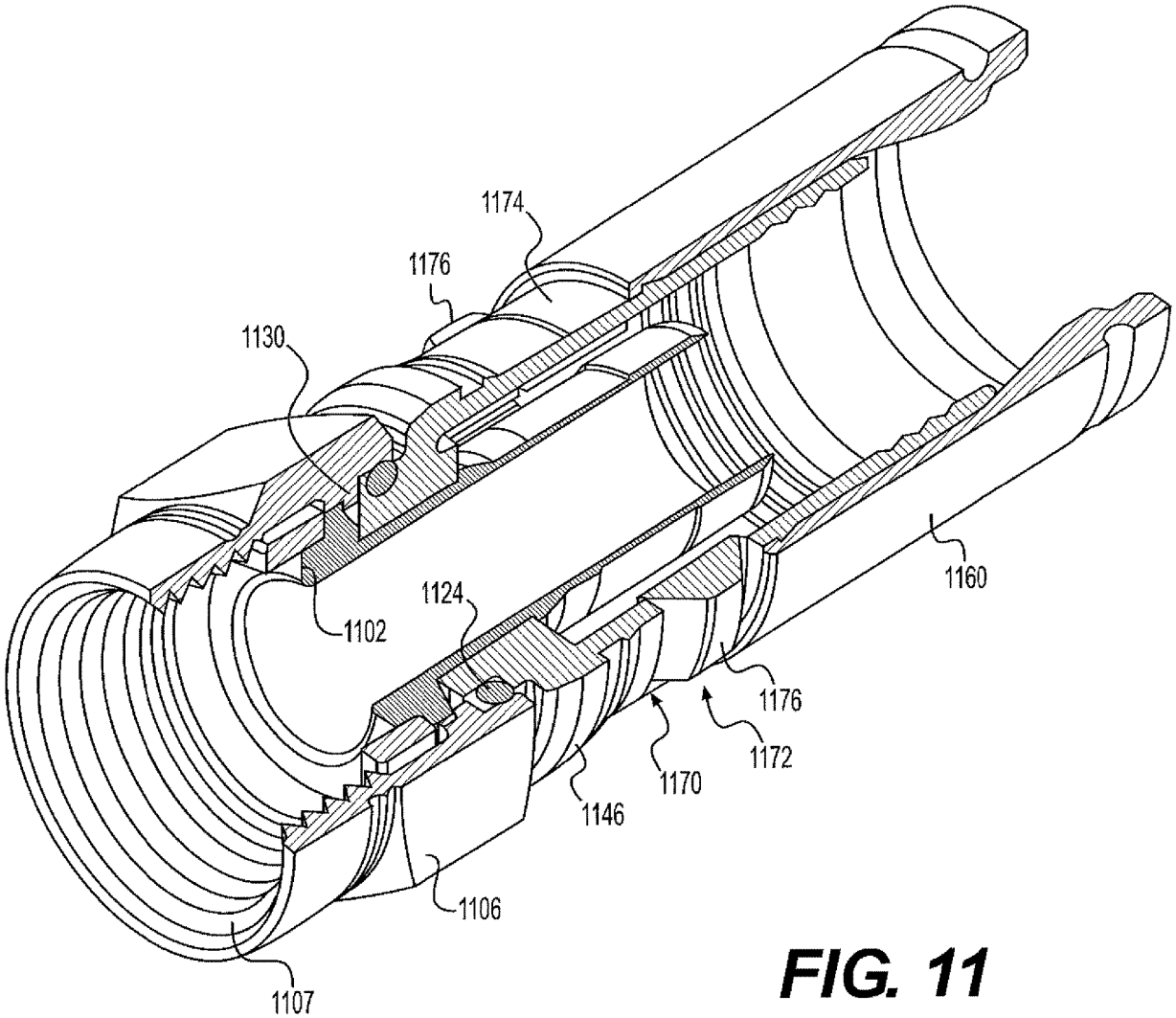
FIG. 11 is a cutaway perspective view of the connector of FIG. 10.
Figure 12:
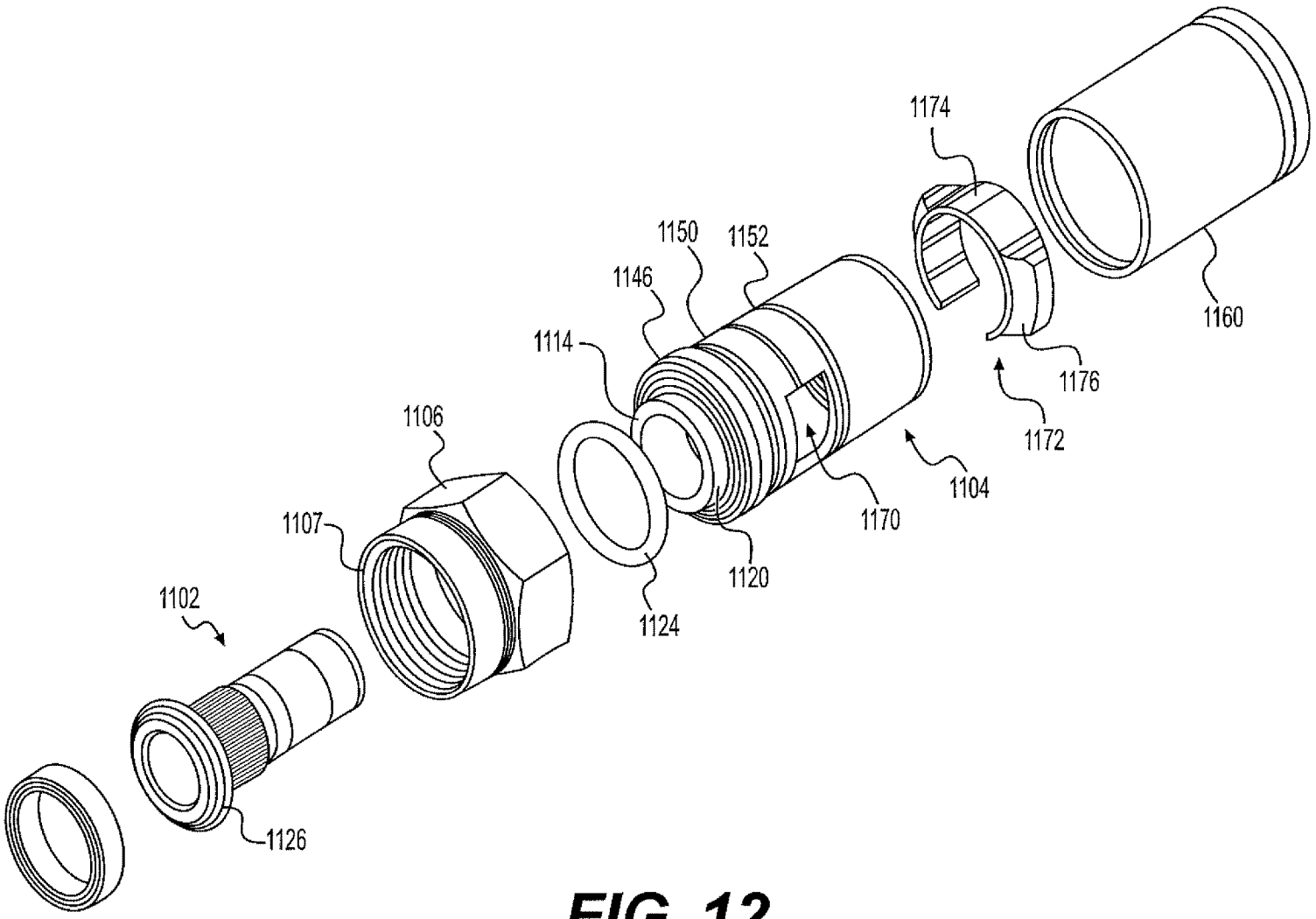
FIG. 12 is an exploded view of the connector of FIG. 10.
Figure 13:
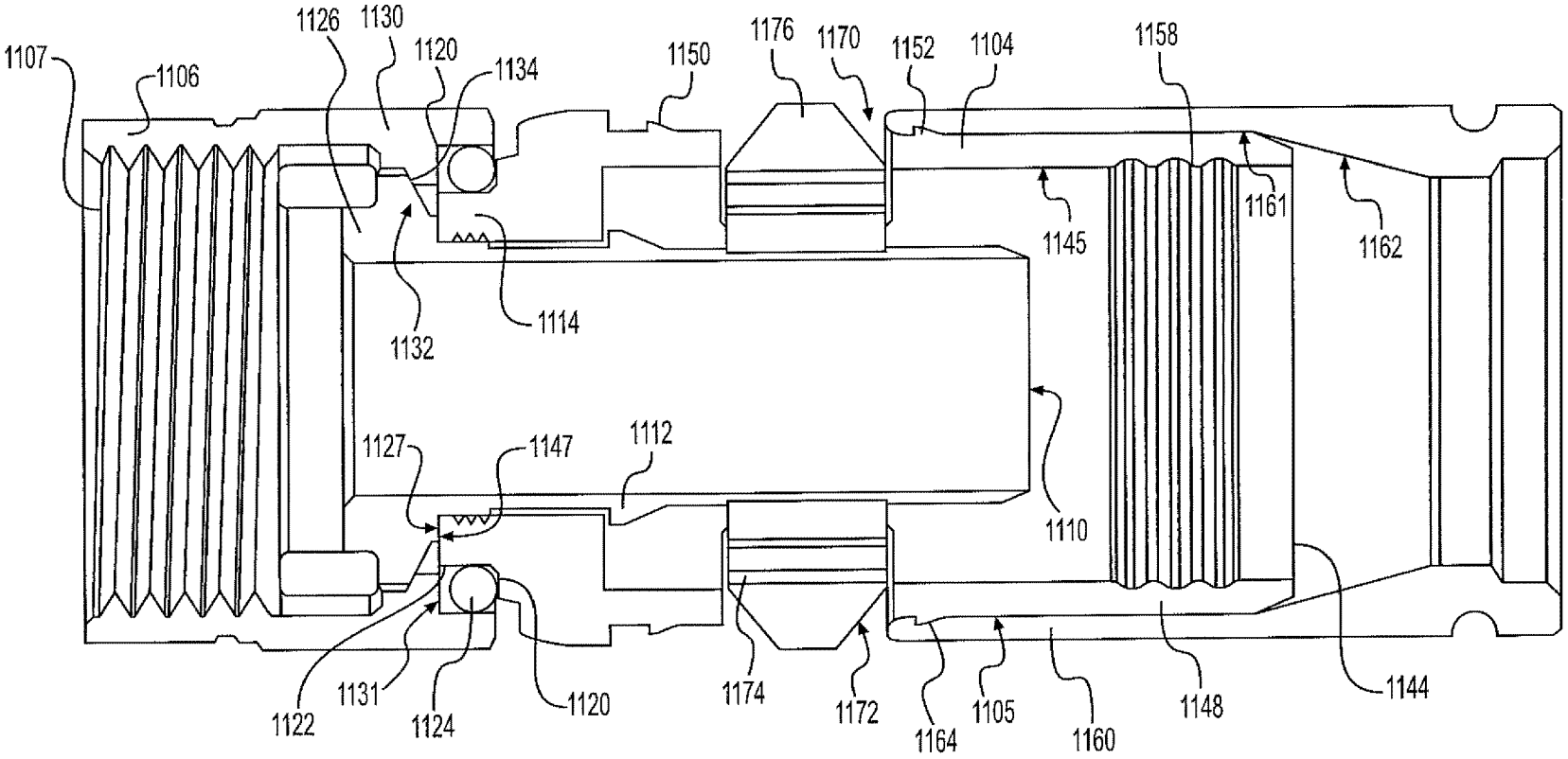
FIG. 13 is a side cross-sectional view of the connector of FIG. 10.

As shown in FIG. 10, in the partially-installed state, the coaxial cable 4 is inserted into the connector 1100 (not shown). For example, the inner conductor 44, the insulator 46, the outer conductor 50, and the outer jacket 52 are inserted through the aperture 1144 of the body 114. Particularly, the coaxial cable 4 is inserted into the connector 1100 until a forward stop surface along the outer jacket 52 of the coaxial cable 4 abuts a rearward-facing stop surface 1168 of the connector body 1104. The inner conductor 44 and the insulator 46 extend through the aperture 1110, and the inner conductor 44 extends beyond the forward flange 1114 of the outer conductor engager 1102.

The cable 4 may be inserted into connector 1100 with the compression sleeve 1160 coupled to the rear portion 1148 of the connector body 1104. Once the cable 4 is properly inserted, the compression sleeve 1160 may be moved forward from a first position, as shown in FIG. 10, to a second position, where the compression sleeve 1160 is moved axially forward so that the tapered inner wall 1162 of the compression sleeve rides over the rear annular ring portion 1148 of the connector body 1104. A suitable tool may be used to effect movement of compression sleeve 1160 from its first position to its second position securing the cable 4 to the connector body 1104 by means of the annular notch 1164 engaging the forward circumferential ridge 1150, which also prevents the compression ring 1160 from becoming inadvertently moved relative to the connector body 1104.

As the compression sleeve 1160 is urged to move forwardly, the connector body 1104 is compressed on the outer jacket 52 of the coaxial cable 4 as the tapered inner wall 1162 rides over the rear annular ring portion 1148 of the connector body 1104 and urges the rear annular ring portion 1148, including the annular ridges 1158, radially inward against the outer jacket 52. As the forward end of the compression sleeve 1160 moves axially over the raised portions 1176, the raised portions 1176 are urged radially inward. The radially inward urging of the raised portions 1176 causes the band portion 1174 to compress the outer jacket 52 and the outer conductor 50 between the of the clamp member 1172 and the barbs 1112 of the outer conductor engager 1102.

During installation of the connector 1100 to an interface port 14, the coupler 1106 threadably engages the interface port 14. As the coupler 1106 is fastened to the interface port 14, for example, by rotating the coupler 1106 relative to the interface port 14, the interface port 14 is drawn toward the forward flange 1114 of the outer conductor engager 1102. Eventually, the grounding member (not shown) is compressed between the forward facing surface 1147 of the forward annular ring portion 1146 of the connector body 1104 and the rearward facing surfaces 1131, 1127, respectively, of the inwardly-extending flange 1130 of the coupler 1106 and the outwardly extending flange 1126 of the forward flange 1114, and the free end of the interface port 14 will engage the forward flange 1114 of the outer conductor engager 1112.

The embodiment of the present disclosure provides an apparatus and method for producing a reliable electrical ground, a secure mechanical connection, and one or more watertight seals to protect the coaxial cable connector.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A cable connector comprising:

an outer conductor engager configured to receive an end of a coaxial cable;

a body including an annular ring portion that is configured to be coaxially aligned with the outer conductor engager when the connector is assembled;

a coupler rotatably mounted relative to the outer conductor engager and the body when the connector is assembled;

a clamp member that includes a band portion and at least one raised portion extending radially outward from the band portion; and a compression sleeve that is configured to urge a portion of the clamp member radially inward to clamp the end of the coaxial cable between an inner surface of the clamp member and the outer conductor engager as the compression sleeve is moved axially relative to the outer conductor engager when the connector is assembled;

wherein the body includes at least one opening corresponding to the at least one raised portion of the clamp member; and wherein the band portion is disposed at an interior of the body, and the at least one raised portion extends radially outward through the at least one opening in the body.

2. The cable connector of claim 1, wherein the at least one raised portion extends radially outward beyond an outer circumferential surface of the body.

3. The cable connector of claim 2, wherein the compression sleeve is configured to urge the at least one raised portion of the clamp member radially inward, which in turn urges the band portion of the clamp member radially inward as the compression sleeve is moved axially relative to the outer conductor engager.

4. A cable connector, comprising:

a body including an annular ring portion extending along an axis, the annular ring being configured to circumscribe a coaxial cable;

a coupler rotatably mounted relative to the body;

a compression sleeve disposed at an opposite axial side of the body relative to the coupler, and including a radially outermost surface;

a clamp member configured to circumscribe the end of the coaxial cable;

wherein the compression sleeve is configured to urge the clamp member radially inward to clamp the end of the coaxial cable as the compression sleeve is moved axially from a first position to a second position;

wherein the clamp member includes a band portion and at least one raised portion configured to radially extend outward from the band portion;

wherein the at least one raised portion of the clamp member is configured to radially extend outward further than an outer circumferential surface of the body when the compression sleeve is in the first position; and wherein the band portion is configured to be at least partially located in the body when the compression sleeve is in the second position.

5. The cable connector of claim 4, wherein the body includes at least one opening corresponding to the at least one raised portion.

6. The cable connector of claim 4, further comprising an outer conductor engager configured to receive an end of the coaxial cable, and wherein the annular ring portion is coaxially aligned with the outer conductor engager along the axis.

7. The cable connector of claim 6, further comprising a grounding member configured to establish an electrical grounding path between the outer conductor engager and the coupler.

8. A coaxial cable connector for gripping a coaxial cable comprising:

a post member configured to form an electrical ground path between the post member and an outer conductor of a coaxial cable when the connector is assembled on the coaxial cable;

a body member that includes a body member opening portion;

a clamp member that includes a band portion and a raised portion that is configured to extend through the body member opening portion when the connector is assembled;

wherein the clamp member is configured to radially clamp a portion of the outer conductor of the coaxial cable against a clamp contact portion of the post member so as to form the electrical ground path between the post member and the outer conductor of the coaxial cable when the connector is assembled on the coaxial cable;

wherein the clamp member is configured to radially clamp the portion of the outer conductor of the coaxial cable against the portion of the post member when a compression sleeve member moves between a pre-installed position and an installed position relative to the body member;

wherein the raised portion of the clamp member is configured to move radially inward so as to radially clamp the portion of the outer conductor of the coaxial cable against the portion of the post member when the connector is assembled on the coaxial cable;

wherein the raised portion of the clamp member is configured to radially extend through the body member opening when the connector is assembled; and wherein the band portion is configured to be at least partially located in the body member when the connector is assembled.

9. The connector of claim 8, wherein the clamp member is configured to expand such that the raised portion of the clamp member radially moves outward relative to the body member when the coaxial cable is inserted into the body member.

10. The connector of claim 8, wherein the clamp member is configured to contract such that the raised portion of the clamp member radially moves inward relative to the body member so as to radially clamp the portion of the outer conductor of the coaxial cable against the portion of the post member when the connector is assembled on the coaxial cable.

11. The connector of claim 8, wherein the clamp contact portion of the post member comprises a barbed portion that is configured to be aligned with the raised portion of the clamp member when the connector is assembled on the coaxial cable so as to radially clamp the portion of the outer conductor of the coaxial cable against the barbed portion of the post member so as to form the electrical ground path between the post member and the outer conductor of the coaxial cable when the connector is assembled on the coaxial cable.

12. The connector of claim 8, wherein the band portion comprises a C-shaped band portion.

13. The connector of claim 8, wherein the body member opening portion comprises a plurality of body member opening portions, and the raised portion of the clamp member comprises a plurality of raised portions.

14. The connector of claim 13, wherein the plurality of body member opening portions comprise a first body member opening portion and a second body member opening portion that is located at a diametrically opposed location about a periphery of the body member relative to the first body member opening portion.

15. The connector of claim 14, wherein the plurality of raised portions of the clamp member comprise a first raised portion that is configured to be aligned with the first body member opening portion and a second raised portion that is configured to be aligned with the second body member opening portion when the connector is assembled.

16. The connector of claim 8, wherein the body member includes a first ridge portion and a second ridge portion, and the compression sleeve member includes a notch portion that is configured to engage the first ridge portion so as to maintain the compression sleeve member in the pre-installed position and engage the second ridge portion so as to maintain the compression sleeve member in the installed position.

17. The connector of claim 16, wherein the notch portion is configured to be continuous about a periphery of an inner surface of the compression sleeve member.

18. The connector of claim 16, wherein the notch portion is configured to be intermittent about a periphery of an inner surface of the compression sleeve member.

19. The connector of claim 8, wherein the post member, body member, and clamp member are separate components from one another.

20. A coaxial cable connector for gripping a coaxial cable comprising:

a post portion having an outer post contact portion, and configured to form an electrical ground path between the outer post contact portion and an outer conductor contact portion of a coaxial cable when the connector is assembled on the coaxial cable;

a body portion having an outermost body surface and an innermost body surface, and configured to receive an outer clamp contact portion of the coaxial cable when the connector is assembled on the coaxial cable; and a clamping portion having an outermost surface and an innermost surface, and configured to be compressed from a partially-installed position, where the outermost surface of the clamping portion is radially urged outside of the outermost body surface of the body portion when the body portion receives the outer clamp contact portion of the coaxial cable, to an installed position, where the innermost surface of the clamping portion is radially compressed inward from the innermost body surface of the body portion, so as to clamp the outer clamp contact portion of the coaxial cable against the outer post contact portion of the post portion and form the electrical ground path with the outer conductor contact portion of the coaxial cable when the connector is assembled on the coaxial cable, wherein the body portion comprises a body member having a body member opening portion, and the clamping portion comprises a clamping member that includes a band portion and a raised portion that is configured to extend through the body member opening portion when the connector is assembled.

21. The connector of claim 20, wherein the post portion comprises a post member, the body portion comprises a body member, and the clamping portion comprises a clamping member.

22. The connector of claim 21, wherein the post member, the body member, and the clamping member each comprise separate components from each other.

23. The connector of claim 20, wherein the raised portion of the clamping member is configured to move radially inward so as to radially clamp the outer conductor contact portion of the coaxial cable against the outer post contact portion of the post member when the connector is assembled on the coaxial cable.

24. The connector of claim 23, wherein the band portion is configured to be at least partially located in the body member when the connector is assembled.

25. The connector of claim 23, wherein the band portion comprises a C-shaped band portion.

26. The connector of claim 23, wherein the body member opening portion comprises a plurality of body member opening portions, and the raised portion of the clamping member comprises a plurality of raised portions.

27. The connector of claim 26, wherein the plurality of body member opening portions comprise a first body member opening portion and a second body member opening portion that is located at a diametrically opposed location about a periphery of the body member relative to the first body member opening portion.

28. The connector of claim 27, wherein the plurality of raised portions of the clamp member comprise a first raised portion that is configured to be aligned with the first body member opening portion and a second raised portion that is configured to be aligned with the second body member opening portion when the connector is assembled.

29. The connector of claim 20, wherein the clamping portion comprises a clamping member that is configured to radially clamp the outer conductor contact portion of the coaxial cable against the outer post contact portion of the post portion when a compression sleeve member moves between a pre-installed location and an installed location relative to the body portion.

30. The connector of claim 20, wherein the body portion comprises a body member, the clamping portion comprises a clamping member having a raised portion, and the clamping member is configured to expand such that the raised portion radially moves outward relative to the body member when the coaxial cable is inserted into the body member.

31. The connector of claim 20, wherein the body portion comprises a body member, the clamping portion comprises a clamping member having a raised portion, and the clamping member is configured to contract such that the raised portion of the clamp member radially moves inward relative to the body member so as to radially clamp the outer conductor contact portion of the coaxial cable against the outer post contact portion when the connector is assembled on the coaxial cable.

32. The connector of claim 20, wherein the clamping portion comprises a raised portion, and the outer post contact portion comprises a barbed portion that is configured to be aligned with the raised portion when the connector is assembled on the coaxial cable so as to radially clamp the outer conductor contact portion of the coaxial cable against the barbed portion so as to form the electrical ground path with the outer conductor contact portion of the coaxial cable when the connector is assembled on the coaxial cable.

33. The connector of claim 20, wherein the body portion a ridge portion that is configured to engage a notch portion of a compression sleeve when the compression sleeve is in a partially-installed location so as to prevent the compression sleeve from moving toward a rearward direction and maintain the compression sleeve member in the pre-installed location, while allowing the compression sleeve to move to an installed location.

34. The connector of claim 33, wherein the ridge portion is configured to be continuous about a periphery of the body portion.

35. The connector of claim 33, wherein the ridge portion is configured to be intermittent about a periphery of the body portion.

36. The connector of claim 20, wherein the body portion comprises a ridge portion that is configured to engage a notch portion of a compression sleeve when the compression sleeve is in an installed location so as to prevent the compression sleeve from moving toward a rearward direction and maintain the compression sleeve member in the installed location.

37. The connector of claim 36, wherein the ridge portion is configured to be continuous about a periphery of the body portion.

38. The connector of claim 36, wherein the ridge portion is configured to be intermittent about a periphery of the body portion.

39. The connector of claim 20, wherein the body portion comprises a body member includes that first ridge portion and a second ridge portion, the first ridge portion being configured to engage a notch portion of a compression sleeve when the compression sleeve is in a partially-installed location so as to prevent the compression sleeve from moving toward a rearward direction and maintain the compression sleeve member in the pre-installed location relative to first ridge portion, while allowing the compression sleeve to move to an installed location, and the second ridge portion being configured to engage the notch portion of the compression sleeve when the compression sleeve is in the installed location so as to maintain the compression sleeve member in the installed location.

40. The connector of claim 20, wherein the clamping portion integrally extends from the body portion.

41. The connector of claim 20, wherein the clamping portion is integral with the body portion.

42. The connector of claim 20, wherein the clamping portion is a continuous monolithic structure of the body portion.

43. The connector of claim 20, wherein the clamping portion and the body portion comprise separate components from each other.

44. The connector of claim 20, wherein the clamping portion extends from the body portion so as to be pivotally compressed from the partially-installed position to the installed position.

45. The connector of claim 20, wherein the clamping portion comprises a finger that is configured to be pivotally compressed from the partially-installed position to the installed position.

46. A coaxial cable connector for gripping a coaxial cable comprising:

a post means for forming an electrical ground path between an outer post contact portion of the post means and an outer conductor contact portion of a coaxial cable when the connector is assembled on the coaxial cable;

a body means for receiving an outer clamp contact portion of the coaxial cable when the connector is assembled on the coaxial cable; and a clamping means for being compressed from a partially-installed position, where an outermost surface of the clamping means is radially urged outside of a outermost body surface of the body means when the body means receives the outer clamp contact portion of the coaxial cable, to an installed position, where an inner surface of the clamping means is radially compressed inward from an innermost body surface of the body means, so as to clamp the outer clamp contact portion of the coaxial cable against the outer post contact portion of the post means and form the electrical ground path with the outer conductor contact portion of the coaxial cable when the connector is assembled on the coaxial cable, wherein the body means comprises a body member having a body member opening portion, and the clamping means comprises a clamping member that includes a band portion and a raised portion that is configured to extend through the body member opening portion when the connector is assembled.

47. The connector of claim 46, wherein post means comprises a post member, the body means comprises a body member, and the clamping means comprises a clamping member.

48. The connector of claim 47, wherein the post member, body member, and clamping member each comprise separate components from each other.

49. The connector of claim 46, wherein the raised portion of the clamping member is configured to move radially inward so as to radially clamp the outer conductor contact portion of the coaxial cable against the outer post contact portion of the post member when the connector is assembled on the coaxial cable.

50. The connector of claim 49, wherein the band portion is configured to be at least partially located in the body member when the connector is assembled.

51. The connector of claim 49, wherein the band portion comprises a C-shaped band portion.

52. The connector of claim 49, wherein the body member opening portion comprises a plurality of body member opening portions, and the raised portion of the clamping member comprises a plurality of raised portions.

53. The connector of claim 52, wherein the plurality of body member opening portions comprise a first body member opening portion and a second body member opening portion that is located at a diametrically opposed location about a periphery of the body member relative to the first body member opening portion.

54. The connector of claim 53, wherein the plurality of raised portions of the clamp member comprise a first raised portion that is configured to be aligned with the first body member opening portion and a second raised portion that is configured to be aligned with the second body member opening portion when the connector is assembled.

55. The connector of claim 46, wherein the clamping means comprises a clamping member that is configured to radially clamp the outer conductor contact portion of the coaxial cable against the outer post contact portion of the post means when a compression sleeve member moves between a pre-installed location and an installed location relative to the body means.

56. The connector of claim 46, wherein the body means comprises a body member, the clamping means comprises a clamping member having a raised portion, and the clamping member is configured to expand such that the raised portion radially moves outward relative to the body member when the coaxial cable is inserted into the body member.

57. The connector of claim 46, wherein the body means comprises a body member, the clamping means comprises a clamping member having a raised portion, and the clamping member is configured to contract such that the raised portion of the clamp member radially moves inward relative to the body member so as to radially clamp the outer conductor contact portion of the coaxial cable against the outer post contact portion when the connector is assembled on the coaxial cable.

58. The connector of claim 46, wherein the clamping means comprises a raised portion, and the outer post contact portion comprises a barbed portion that is configured to be aligned with the raised portion when the connector is assembled on the coaxial cable so as to radially clamp the outer conductor contact portion of the coaxial cable against the barbed portion so as to form the electrical ground path with the outer conductor contact portion of the coaxial cable when the connector is assembled on the coaxial cable.

59. The connector of claim 46, wherein the body means a ridge portion that is configured to engage a notch portion of a compression sleeve when the compression sleeve is in a partially-installed location so as to prevent the compression sleeve from moving toward a rearward direction and maintain the compression sleeve member in the pre-installed location while allowing the compression sleeve to move to an installed location.

60. The connector of claim 59, wherein the ridge portion is configured to be continuous about a periphery of the body means.

61. The connector of claim 59, wherein the ridge portion is configured to be intermittent about a periphery of the body means.

62. The connector of claim 46, wherein the body means comprises a ridge portion that is configured to engage a notch portion of a compression sleeve when the compression sleeve is in an installed location so as to prevent the compression sleeve from moving toward a rearward direction and maintain the compression sleeve member in the installed location.

63. The connector of claim 62, wherein the ridge portion is configured to be continuous about a periphery of the body means.

64. The connector of claim 46, wherein the body means comprises a body member includes that first ridge portion and a second ridge portion, the first ridge portion being configured to engage a notch portion of a compression sleeve when the compression sleeve is in a partially-installed location so as to prevent the compression sleeve from moving toward a rearward direction and maintain the compression sleeve member in the pre-installed location relative to first ridge portion, while allowing the compression sleeve to move to an installed location, and the second ridge portion being configured to engage the notch portion of the compression sleeve when the compression sleeve is in the installed location so as to maintain the compression sleeve member in the installed location.

65. The connector of claim 46, wherein the clamping means integrally extends from the body means.

66. The connector of claim 46, wherein the clamping means is integral with the body means.

67. The connector of claim 46, wherein the clamping means and the body means comprise separate components from each other.

68. The connector of claim 46, wherein the clamping means extends from the body means so as to be pivotally compressed from the partially-installed position to the installed position.

69. The connector of claim 46, wherein the clamping means comprises a finger that is configured to be pivotally compressed from the partially-installed position to the installed position.

* * * * *